US007445643B2

(12) United States Patent
Sadlowski et al.

(10) Patent No.: US 7,445,643 B2
(45) **Date of Patent: *Nov. 4, 2008**

(54) AUTOMATIC MACHINE LAUNDERING OF FABRICS

(75) Inventors: Eugene Steven Sadlowski, Cincinnati, OH (US); Vincent John Becks, Hamilton, OH (US); Yousef Georges Aouad, Cincinnati, OH (US); Jean Wevers, Steenhuffel (BE)

(73) Assignee: The Procter & Gamble Company, Cincinnati, OH (US)

( * ) Notice: Subject to any disclaimer, the term of this patent is extended or adjusted under 35 U.S.C. 154(b) by 256 days.

This patent is subject to a terminal disclaimer.

(21) Appl. No.: 11/003,896

(22) Filed: Dec. 3, 2004

(65) Prior Publication Data

US 2005/0124521 A1 Jun. 9, 2005

Related U.S. Application Data

(60) Provisional application No. 60/526,642, filed on Dec. 3, 2003.

(51) Int. Cl.
*D06L 3/00* (2006.01)
*D06L 3/16* (2006.01)

(52) U.S. Cl. ..... 8/137

(58) Field of Classification Search ..... 8/137
See application file for complete search history.

(56) References Cited

U.S. PATENT DOCUMENTS 3,856,684 A * 12/1974 Atkinson ..... 510/330
3,912,681 A * 10/1975 Dickson ..... 524/422
3,988,908 A 11/1976 Beare et al.
4,026,131 A 5/1977 Dugger et al.
4,186,573 A 2/1980 Brenner et al.
4,239,659 A * 12/1980 Murphy ..... 510/331
4,260,054 A 4/1981 Bory et al.
4,265,372 A 5/1981 Wainberg
4,379,515 A 4/1983 Towsend
4,416,791 A 11/1983 Haq
4,429,812 A 2/1984 Steiner et al.
4,588,080 A 5/1986 Ginn (Continued)

FOREIGN PATENT DOCUMENTS

CA 1 133 712 10/1982

(Continued)

*Primary Examiner*—Lorna M Douyon
(74) *Attorney, Agent, or Firm*—Mark A. Charles; David V. Upite; Kim William Zerby

(57) ABSTRACT

Provided is a method of laundering fabrics in an automatic washing machine having a drum, wherein the automatic washing machine is operated so as to cause it to run through at least one wash cycle and at least one rinse cycle, which method comprises: during the at least one wash cycle forming in the drum an aqueous washing liquor containing a detersive surfactant component and a detergent builder component, the aqueous wash liquor having pH above about 7; contacting fabrics to be laundered with the aqueous wash liquor in the drum; during the rinse cycle, forming in the drum an aqueous rinse liquor and contacting the fabrics with the rinse liquor; and adding to the rinse liquor sufficient acid source to bring the pH of the rinse liquor into the range of from about 4 to about 7.

15 Claims, 6 Drawing Sheets

U.S. PATENT DOCUMENTS

| | | | | |
|---|---|---|---|---|
| 4,637,890 | A | 1/1987 | Crabtree et al. | |
| 4,700,857 | A | 10/1987 | Kittscher et al. | |
| 4,882,917 | A | 11/1989 | Mizusawa et al. | |
| 4,982,467 | A | 1/1991 | Mizusawa et al. | |
| 5,033,643 | A | 7/1991 | Schumacher | |
| 5,061,807 | A | 10/1991 | Gethöffer et al. | |
| 5,129,120 | A | 7/1992 | Cornette et al. | |
| 5,133,487 | A | 7/1992 | Russi | |
| 5,176,297 | A | 1/1993 | Mooney et al. | |
| 5,536,421 | A | 7/1996 | Hartman et al. | |
| 5,599,782 | A * | 2/1997 | Pan et al. | 510/299 |
| 5,687,588 | A | 11/1997 | Azzani et al. | |
| 5,732,853 | A | 3/1998 | Ganzeboom et al. | |
| 5,768,918 | A * | 6/1998 | McKibben | 68/17 R |
| 5,792,219 | A | 8/1998 | Hartman et al. | |
| 6,138,693 | A | 10/2000 | Matz | |
| 6,179,167 | B1 | 1/2001 | Boot et al. | |
| 6,203,535 | B1 | 3/2001 | Barney et al. | |
| 6,281,183 | B1 | 8/2001 | Harbour | |
| 6,352,158 | B1 | 3/2002 | Cole-Bennett et al. | |
| 6,378,274 | B1 | 4/2002 | Harbour | |
| 6,439,387 | B1 | 8/2002 | Bergman | |
| 6,956,016 | B2 * | 10/2005 | Speed et al. | 510/296 |
| 7,036,176 | B2 * | 5/2006 | Aouad et al. | 8/159 |
| 7,036,177 | B2 * | 5/2006 | Aouad et al. | 8/159 |
| 7,086,110 | B2 * | 8/2006 | Aouad | 8/159 |
| 7,219,518 | B2 * | 5/2007 | Aouad et al. | 68/17 R |
| 7,340,790 | B2 * | 3/2008 | Aouad et al. | 8/158 |
| 2001/0049846 | A1 | 12/2001 | Guzzi et al. | |
| 2002/0078589 | A1 | 6/2002 | Hagemann et al. | |
| 2002/0088502 | A1 | 7/2002 | Van Rompuy et al. | |
| 2002/0100773 | A1 | 8/2002 | Rodd et al. | |
| 2002/0108969 | A1 | 8/2002 | Rodd et al. | |
| 2002/0155983 | A1 | 10/2002 | Grimm et al. | |
| 2003/0172960 | A1 | 9/2003 | Aouad et al. | |
| 2003/0172961 | A1 | 9/2003 | Aouad et al. | |
| 2003/0182732 | A1 | 10/2003 | Davenet et al. | |
| 2004/0088796 | A1 | 5/2004 | Neergaard et al. | |
| 2004/0221625 | A1 * | 11/2004 | Aouad | 68/17 R |

FOREIGN PATENT DOCUMENTS

| | | | |
|---|---|---|---|
| DE | 39 22 342 | | 1/1991 |
| DE | 39 34 123 | | 4/1991 |
| DE | 199 23 303 | A1 | 11/2000 |
| DE | 101 14 256 | A1 | 3/2001 |
| DE | 199 45 849 | | 3/2001 |
| EP | 0 215 366 | | 9/1986 |
| EP | 0 323 395 | A2 | 7/1989 |
| EP | 0 351 671 | | 1/1990 |
| EP | 1 195 350 | | 4/2002 |
| WO | WO 94/07979 | | 4/1994 |
| WO | WO 96/26312 | | 8/1996 |
| WO | WO 97/09480 | | 3/1997 |
| WO | WO 00/02982 | | 1/2000 |
| WO | WO 00/02987 | | 1/2000 |
| WO | WO 00/29537 | | 5/2000 |
| WO | WO 00/49218 | | 8/2000 |
| WO | WO 01/07702 | | 2/2001 |
| WO | WO 01/07703 | | 2/2001 |
| WO | WO 01/07704 | | 2/2001 |
| WO | WO 01/16271 | | 3/2001 |
| WO | WO 01/23295 | | 4/2001 |
| WO | WO 01/25526 | | 4/2001 |
| WO | WO 01/25527 | | 4/2001 |
| WO | WO 03/069042 | | 8/2003 |
| WO | WO 03/069043 | | 8/2003 |
| WO | WO 2004/044303 | A1 | 5/2004 |

* cited by examiner

AUTOMATIC MACHINE LAUNDERING OF FABRICS

CROSS REFERENCE TO RELATED APPLICATIONS

This application claims the benefit of U.S. Provisional Application No. 60/526,642, filed on Dec. 3, 2003.

FIELD OF THE INVENTION

This invention relates to methods of laundering fabrics in an automatic washing machine in a cycle having a wash cycle, a rinse cycle and preferably a spin cycle between the wash cycle and the rinse cycle. It also relates to systems which can be used to add wash and rinse additives into such a wash process.

BACKGROUND OF THE INVENTION

It is well known to launder fabrics in automatic washing machines. A standard automatic washing machine operation includes at least one wash cycle (and in some cases more than one wash cycle), a spin cycle which removes significant proportions of the washing liquor from the wash cycle and a final rinse cycle.

Cleaning agents such as surfactants and detergent builders are commonly added to the washing machine drum in the wash cycle to assist in the mechanical removal of soil and stains from fabrics.

It is also known to add additional materials, in particular fabric care benefit agents such as softeners, feel modifiers and anti-wrinkle agents, during the rinse cycle and not during the wash cycle, in order to avoid interference from other components present in the wash liquor during prior stages of the laundering operation. Certain of these materials are required to be deposited on the fabric in order to give the maximum benefit. This applies, for instance, to perfumes, brightening agents, fabric care benefit agents and soil release agents. It would be desirable to maximize the potential for deposition of these materials on the fabric when added to the rinse cycle.

The pH of the aqueous wash liquor during the wash cycle is generally high, in particular above 7 and most commonly at least 9, often in the range 10.5 to 12.5, and sometimes higher. Due to the different nature of additives commonly included in the rinse cycle and the removal of the majority of the wash liquor, the pH of the rinse liquor is generally lower than that in the wash cycle but is not usually below 7.

It has been known to rinse laundry with a solution or rinse bath having a pH below 7, but this has not been done in the context of automatic washing machine processes. Automatic washing machine processes have special requirements in that it is usual to include a complex detergent composition in the wash cycle and it is common to include a variety of fabric types in a single wash.

In particular, manufacturers of laundry washing compositions are constantly striving to improve the properties of such compositions while retaining a composition which is technically and economically attractive. In particular, removal of greasy stains and removal of bleachable stains is an aspect which generally requires improvement but the types of component of a laundry washing composition which improve such performance tend to be some of the more expensive components, such as bleach components. Therefore it would be desirable to provide means by which these problems could be addressed without the necessity to increase the level of expensive components.

A problem which occurs with automatic washing machine processing is one of gradual residue deposition on the laundry over a number of washes. This residue can lead to a gradual dulling of dark colored fabrics or generally inducing a "dingy" appearance in white or other pale fabrics. It also makes removal of stains from the surface of the fabric on which the residue has deposited more difficult. Again, it would be desirable to provide methods for addressing these problems without necessarily requiring expensive components in the laundry washing composition.

SUMMARY OF THE INVENTION

According to this invention there is provided a method of laundering fabrics in an automatic washing machine having a drum, operating the automatic washing machine so as to cause it to run through at least one wash cycle and at least one rinse cycle, the method comprising:

(a) during the at least one wash cycle forming in the drum an aqueous wash liquor containing a detersive surfactant component and a detergent builder component, the aqueous wash liquor having pH above 7;

(b) contacting the fabrics to be laundered with the aqueous wash liquor in the drum;

(c) during the rinse cycle forming in the drum an aqueous rinse liquor and contacting fabrics with the rinse liquor;

(d) adding to the rinse liquor sufficient acid source to bring the pH of the rinse liquor in the range of from about 4 to about 7, preferably from about 4.5 to about 6.5.

For the first time, there is provided an automatic laundry washing method in which the pH of the rinse liquor is brought into the range of from 4 to 7, preferably 4.5 to 6.5. It has been found that this gives a wide variety of benefits in combination with a number of different rinse additives, as discussed hereinafter.

It has also been found that the use of a low pH rinse liquor has, in itself, particular benefits in the context of automatic laundry washing processes, even if no rinse additive is included in the rinse cycle. Consequently, according to a second aspect of this invention, there is provided use of a pH from about 4 to about 7, preferably from about 4.5 to about 6.5, in the rinse cycle of an automatic laundry washing process to improve decolorization of bleachable stains and/or to promote grease removal and/or to promote cleaning of complex soils, and/or to reduce dye transfer and/or to reduce build-up of residue on fabrics. In this context "complex soils" are built up combinations of body soil, detergent, softener and/or hard water residues. The type of residue of which it is believed build-up is reduced is thought to be calcium-containing and associated with hard water washing.

In a third aspect, there is provided a system for providing sequential addition of wash additives and rinse additives to the wash and rinse cycles, respectively, of a fabric laundering operation carried out in a drum-containing automatic washing machine. Such a system comprises:

(a) a unit dose package comprising at least one compartment containing wash additive material comprising a detersive surfactant component and a detergent builder component, said wash additive material serving to provide aqueous wash liquor having a pH of above 7; and at least one additional compartment containing an acid source sufficient to bring the pH of rinse liquor formed during said rinse cycle to a pH of from about 4 to about 7, preferably from about 4.5 to about 6.5;

(b) a rigid housing structure into which at least the rinse additive compartment(s) of said unit dose package can be inserted at the beginning of the laundering operation, said housing structure being positioned within the drum of said automatic washing machine in a location which brings it into significant contact with wash and rinse water during the laundering operation;

(c) means associated with said wash additive material compartment(s) of the unit dose package to open said wash additive compartment(s) and to thereby release the contents of said wash additive compartment(s) into the aqueous wash liquor in said drum;

(d) means associated with said housing structure or with said rinse additive compartment(s) of said unit dose package or with both to open said rinse additive compartment(s) and to thereby release the rinse additive contents thereof into said housing structure, said rinse additive compartment opening means being activated by centrifugal force applied to said rinse additive compartment(s) during the spin cycle occurring in the operation of said automatic washing machine; and (e) means for transferring said rinse additive material from said housing structure into the aqueous rinse liquor formed in said washing machine drum during the rinse cycle of said fabric laundering operation.

DETAILED DESCRIPTION OF THE INVENTION

Figure 1A:
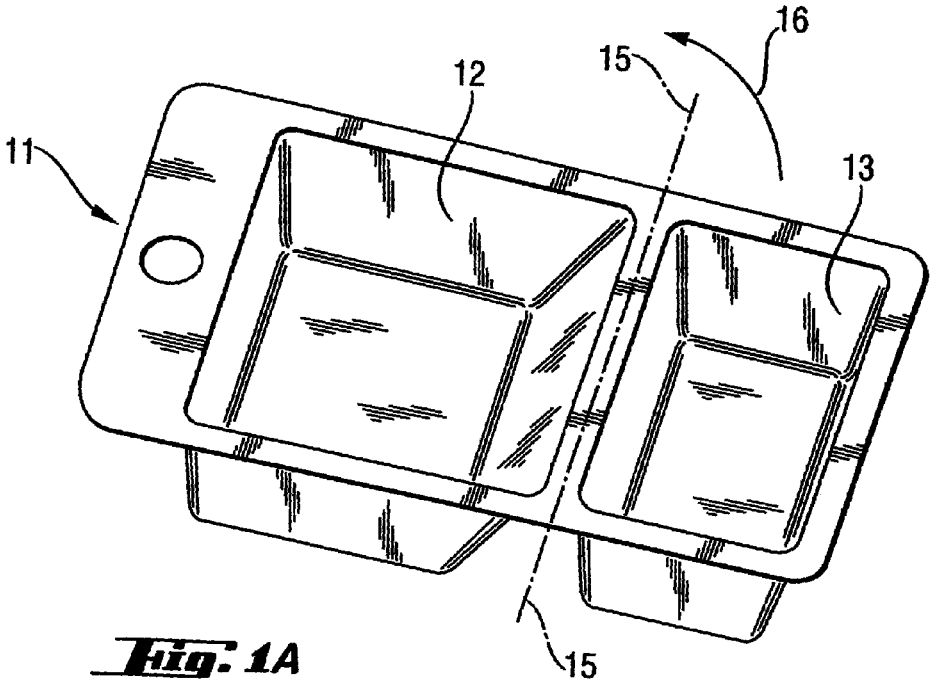
FIG. 1 of the drawings shows top and bottom views of one type of a two-compartment unit dose insert which can be utilized in the present invention.

The invention provides a method of laundering fabrics in an automatic washing machine. The automatic washing machine comprises a drum in which the fabrics are placed for laundering. The aqueous wash liquor and aqueous rinse liquor are formed in the drum. The automatic washing operation has, as is conventional, at least one wash cycle. It may have more than one wash cycle. Multiple wash cycles are often described as a pre-wash cycle and a main wash cycle. In the discussion below the aqueous wash liquor is generally the liquor in the main wash cycle, and in particular in the last wash cycle prior to the rinse cycle. Preferably, the laundry is contacted with the aqueous wash liquor for from about 1 to about 50 mins, more preferably from about 5 to about 40 mins.

Preferably, the operation also includes a spin cycle carried out after the wash cycle, during which the drum is caused to spin, generally at high speed. During the spin cycle the aqueous wash liquor is removed from the washing machine drum. This is partly due to gravitational flow of wash water from the drum through appropriate valve configuration. Some removal is also achieved by means of centrifugal force due to the rapid rotation of the drum. This centrifugal force moves water in the drum through holes or apertures in the circumferential walls of the drum. These holes lead to drainage means which can be opened and shut.

During the spin cycle a large proportion of the aqueous wash liquor in the drum is removed from the drum. Preferably from about 50 to about 99% of the aqueous wash liquor, more preferably from about 60 to about 90% of the aqueous wash liquor is removed.

After the initial spin cycle, clean water is added back to the drum in a rinse cycle. In this invention, sufficient acid source is added to the rinse liquor to bring the pH of the rinse liquor within the range of from about 4 to about 7, preferably from about 4.5 to about 6.5. Washing machine operation may involve more than one spin cycle and/or more than one rinse cycle. However, the invention requires that at least one of the rinse cycles is such that acid source is added to the rinse liquor to bring the pH into the required range. The pH of the rinse liquor can be in the range of from about 4 to about 7, preferably from about 4.5 to about 6.5, in all rinse cycles if more than one is used. In this case, although it is possible to add acid source to the rinse liquor at every rinse cycle, it is also possible to add sufficient acid source in one rinse cycle so that cycle and subsequent rinse cycles include rinse liquor having the required pH.

In methods including more than one rinse cycle it is preferred that at least the final rinse cycle is such that the pH is in the range of from about 4 to about 7, preferably from about 4 to about 5.5. In particular, it is preferred that the acid source is added to the rinse liquor in the final rinse cycle. As a less preferred alternative, the penultimate rinse cycle can be such that the rinse liquor has pH in the range of from about 4 to about 7, preferably from about 4.5 to about 6.5. It has been found that benefits are greater if the acid source is added to the rinse liquor after a significant proportion of wash liquor, containing the detersive surfactant component and the detergent builder component, has been removed from the automatic washing machine.

The pH of the rinse liquor is controlled into the desired range by addition of an acid source. This may be selected from any acidic material or acid precursor compatible with the fabric being laundered and with other components incorporated into the rinse cycle, if any, and components of the detergent composition added to the wash liquor. Inorganic acids can be used, but organic acids are preferred. Polymeric acids may be used, for instance polyacrylic acid, polymaleic acid and acrylic acid/maleic acid copolymers. However, most preferred are mono or polyprotic organic acids having equivalent weight not more than about 80. Particularly preferred examples are maleic acid, citric acid and oxalic acid, with citric acid being particularly preferred.

The level of acid should be chosen to achieve the required pH value in the rinse cycle. However, when low molecular weight organic acids are used, concentrations in the rinse liquor are generally in the range of from about 100 to 1000 ppm It has been surprisingly found that in the context of an automatic washing machine operation the use of acid pH in the rinse cycle, in particular pH in the range of from about 4.5 to about 6.5, leads to particular benefits. It has been found, for instance, that dye transfer from colored fabrics to other fabrics is reduced. Therefore the invention is particularly suitable for laundering dyed fabrics. Due to the reduction in dye transfer achievable in the invention, it is particularly applicable to washing a fabric load which comprises at least some dyed fabrics and at least some pale fabrics.

A further benefit is the reduction in residue build-up on fabrics. On dark fabrics this tends to manifest itself as a whitening effect. Residue build-up can also affect white and other pale fabrics, for instance by inducing "dingy" appearance. Residue can be primarily due to water hardness and essentially calcium-based. However, residue can also include combinations of such water hardness deposits with body soil, detergent and/or softener and/or other washing actives and can be described in that case as complex soil.

It has also been found that the low pH values in the method of the invention can themselves lead to improved soil removal. This is particularly applicable to bleachable stains, such as coffee, tea and wine. Benefits are also seen on greases and grease-containing stains. Benefits are also seen on stains susceptible to removal by enzymes. These include protein-containing stains susceptible to removal by proteases, starch-containing stains susceptible to removal by amylases and grease-containing stains susceptible to removal by lipases, in particular protein-containing and starch-containing stains. Examples are grass, blood and gravy. As a result, the method of this invention is particularly applicable to fabrics stained with any of these types of stains.

In a particularly preferred embodiment of the invention, a laundry rinse additive material is also added to the rinse liquor in addition to the acid source. It has been surprisingly found that use of an acid pH rinse can give particular benefits in terms of improving the properties of certain rinse additives.

Particular benefits arise when the rinse additive is a perfume or pro-perfume (that is, a material which breaks down or otherwise reacts in the rinse liquor to produce a perfume molecule). It has been found that the inclusion of such materials as a rinse additive in a low pH rinse results in improved deposition of the perfume on to the fabric.

A further preferred rinse additive is a chelant. In particular, phosphonate chelants have good performance at acid pH's. Thus inclusion of these in an acid rinse cycle can improve stain removal and also improve removal of accumulated hard water deposits from fabrics. Thus these additives are particularly preferred for use when the load includes colored fabrics, as discussed above in connection with reduction of hard water deposits.

Another preferred rinse additive is a fabric brightening agent. Particularly preferred fabric brightening agents are phthalocyanines, which exhibit better fabric deposition at the pH required in the invention. Preferred brighteners include acid stable fluorescent whitening agents such as Tinopal CBS made by Ciba Geigy (disodium 4,4'-bis-(2-sulfostyryl) biphenyl).

Another preferred group of rinse additives is the group of fabric care benefit agents, such as softeners, feel modifiers and wrinkle modifiers. It has been found that these exhibit better deposition onto fabric and hence greater fabric benefits, at the pH range used in this invention. Preferred softeners include ester quats, alkyl quaternary ammonium salts, clays, silicone oils, silicone polyols and amino silicones. Other fabric care benefit agents include dye fixatives such as cationic oligomers, anti-abrasion agents such as silicones and cellulose and cellulose derivatives, and chlorine scavengers (which can reduce color fading), such as amines, ammonium salts and reducing agents.

A further preferred group of rinse additives is the group of soil release agents and soil repellent agents. These depend for their effectiveness on deposition onto fabric and particular types exhibit better deposition at the pH of the rinse cycle in the method of this invention.

Known polymeric soil release agents, hereinafter "SRA" or "SRA's", can optionally be employed in the present invention. If utilized, SRA's will generally comprise from about 0.01% to 10.0%, typically from 0.1% to 5%, preferably from 0.2% to 3.0% by weight, of the composition.

SRA's can include a variety of charged, e.g., anionic or even cationic (see U.S. Pat. No. 4,956,447), as well as non-charged monomer units, and structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products.

Suitable SRA's include a sulfonated product of a substantially linear ester oligomer comprised of an oligomeric ester backbone of terephthaloyl and oxyalkyleneoxy repeat units, for example as described in U.S. Pat. No. 4,968,451, Nov. 6, 1990 to J.J. Scheibel and E.P. Gosselink. See U.S. Pat. No. 4,711,730, Dec. 8, 1987 to Gosselink et al, for examples of those produced by transesterification/oligomerization of poly (ethyleneglycol)methyl ether, DMT, PG and poly(ethyleneglycol) ("PEG"). Partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, Me-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al. can also be used as rinse additives.

SRA's also include simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; and the $C_1$-$C_4$ alkylcelluloses and $C_4$ hydroxyalkyl celluloses; see U.S. Pat. No. 4,000,093, Dec. 28, 1976 to Nicol, et al. Suitable SRA's characterized by poly(vinyl ester) hydrophobe segments include graft copolymers of poly (vinyl ester), e.g., $C_1$-$C_6$ vinyl esters, preferably poly(vinyl acetate), grafted onto polyalkylene oxide backbones. See European Patent Application 0 219 048, published Apr. 22, 1987 by Kud, et al. Commercially available examples include SOKALAN SRA's such as SOKALAN HP-22, available from BASF, Germany. Other SRA's are polyesters with repeat units containing 10-15% by weight of ethylene terephthalate together with 90-80% by weight of polyoxyethylene terephthalate, derived from a polyoxyethylene glycol of average molecular weight 300-5,000. Commercial examples include ZELCON 5126 from Dupont and MILEASE T from ICI.

See also U.S. Pat. No. 5,415,807, Gosselink, Pan, Kellett and Hall, issued May 16, 1995. Suitable monomers for the above SRA include Na 2-(2-hydroxyethoxy)-ethanesulfonate, DMT, Na-dimethyl 5-sulfoisophthalate, EG and PG.

Additional classes of SRA's include (I) nonionic terephthalates using diisocyanate coupling agents to link up polymeric ester structures, (see U.S. Pat. No. 4,201,824, Violland et al. and U.S. Pat. No. 4,240,918 Lagasse et al;) (II) SRA's with carboxylate terminal groups made by adding trimellitic anhydride to known SRA's to convert terminal hydroxyl groups to trimellitate esters. With a proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524

Tung et al.; (III) anionic terephthalate-based SRA's of the urethane-linked variety, see U.S. Pat. No. 4,201,824, Violland et al; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,681, Ruppert et al.; (V) graft copolymers, in addition to the SOKALAN types from BASF made, by grafting acrylic monomers on to sulfonated polyesters; these SRA's assertedly have soil release and anti-redeposition activity similar to known cellulose ethers: see EP 279,134 A, 1988, to Rhone-Poulenc Chemie; (VI) grafts of vinyl monomers such as acrylic acid and vinyl acetate on to proteins such as caseins, see EP 457,205 A to BASF (1991); (VII) polyester-polyamide SRA's prepared by condensing adipic acid, caprolactam, and polyethylene glycol, especially for treating polyamide fabrics, see Bevan et al, DE 2,335,044 to Unilever N.V., 1974. Other useful SRA's are described in U.S. Pat. Nos. 4,240,918, 4,787,989, 4,525,524 and 4,877,896.

All of the foregoing patent references relating to SRAs are incorporated herein by reference. Preferred soil repellents are fluoropolymers and acrylate polymers. These types of additive in particular have high substantivity to fabrics under acid conditions.

It has been found that benefits are achieved when the rinse additive is a bleach or a bleach catalyst or a mixture of these. Preferred bleaches are oxidative bleaches, ie, those which generate hydrogen peroxide such as perborates and percarbonates. As well as these inorganic peroxygen sources, preferred bleach systems include organic peroxy acids. Inorganic peroxygen sources can be combined with bleach activators or catalysts. Preferred bleach catalysts are those not requiring a formulated peroxide or oxygen source.

It has been found, however, that the use of the defined pH in the rinse stage in the present invention allows lower levels of bleach and/or bleach activator and/or bleach catalyst to be used in the formulation applied to the wash cycle with the achievement of equivalent results. For instance, the level of percarbonate or perborate (or other oxygen bleach) bleach can be below about 15%, preferably below about 12% and even about 10%, in combination with not more than about 3% bleach activator such as TAED, in formulations, such as powder detergents for use in horizontal drum washing machines, which would normally contain about 20% percarbonate or perborate and about 4% bleach activator. The level of percarbonate or perborate (or other oxygen bleach) bleach can be below 4%, preferably below 3% and even about 2.5%, in combination with not more than 5% bleach activator such as TAED, in formulations, such as powder detergents for use in vertical drum washing machines, which would normally contain about 5% percarbonate or perborate and about 6% bleach activator. In liquid detergent compositions the level of bleach such as PAP can be below 2%, in comparison with the more usual 3.5%.

In some cases, this invention even allows the use of no source of bleach in the composition applied in the wash liquor.

A further rinse additive is a dye transfer inhibition agent which prevents the redeposition of dye from one fabric onto another fabric. Preferred dye transfer inhibition agents are polyvinyl pyrrolidone (PVP), poly-4-vinylpyrazine N-oxide (PVNO) and copolymers of N-vinyl-2-pyrrolidone and N-vinyl-imidazole (PVPVI).

The aqueous wash liquor contains a detersive surfactant component and a detergent builder component. Generally these are provided to the aqueous wash liquor as components of a laundry detergent composition. This may be in any appropriate physical form, for instance liquid, powder, granules or tablet form.

A preferred physical form for the detergent composition is liquid. It is particularly preferred that the pH obtained in the wash cycle is in the range from about 7.5 to about 10, preferably from about 7.5 to about 9.

Generally the detergent composition may contain any of the standard components of known detergent compositions. As well as detersive surfactants and detergents builders, materials contained in the wash liquor can include chelating agents, anti redeposition agents, dispersants, suds suppressers, boosters, bleaches and enzymes. A more detailed description of suitable laundry additive materials can be found in WO 00/02982 and WO 00/02987, both incorporated herein by reference.

It has been found that the use of the acid rinse cycle in the method of the invention is particularly beneficial when certain types of material are included in the detergent composition and hence added to the aqueous wash liquor in the wash cycle. For instance, particular benefits arise when the detergent composition added to the wash cycle includes the bleach PAP and, preferably a bleach catalyst.

Other preferred bleaches are aromatic $C_7$ to $C_{30}$ peroxy carboxylic acids and precursors thereof, preferably $C_7$ to $C_{20}$ heteroaromatic peroxy carboxylic acids. Particularly preferred examples include phthalimidoperoxyhexanoic acid (PAP), mentioned above, described in EP-A-349940, and other compounds of the formula:

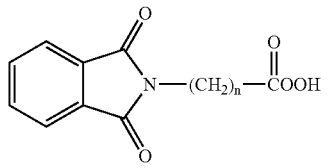

in which n can be from 1 to 18. In PAP n is 5.

The use of an acid rinse allows the level of bleach and activator in the wash to be minimized and thus maximize the cleaning benefit achievable with a given dose of bleach/activator. Suitable bleach catalysts are described in WO 00/29537, WO 01/16271 and WO 02/68574, all incorporated herein by reference.

As discussed above, the use of an acid rinse is particularly beneficial in maximizing grease cleaning. Particular benefits are achieved when the detergent comprises anionic surfactants such as linear alkyl benzene sulfonates, nonionic surfactants such as alkyl ethoxylates or amine oxides, cationic surfactants such as alkyl quaternary ammonium surfactants and amphoteric surfactants such as betaines.

The benefits of use of an acid rinse include improved performance at low temperature. Thus preferably the method is such that the maximum temperature of the aqueous wash liquor and the aqueous rinse liquor is not more than about 60° C., preferably not more than 50° C., more preferably not more than 45° C. In particular, the invention provides benefits where the wash liquor is rather cold and in which the maximum wash liquor temperature is not more than about 35° C., preferably not more than 32° C.

The invention also gives particular benefits when the wash liquor and/or the rinse liquor are of a relatively high degree of hardness, since such wash and rinse liquor lead to particular problems of deposition of residue and resulting fading of colored fabrics and "dinginess" of pale fabrics and the formation of complex soils. Thus the invention is particularly beneficial when the hardness of the wash liquor and/or rinse liquor is at least about 100 ppm $CaCO_3$.

It is particularly preferred that the method of the invention be carried out using preferred devices suitable for delivery of detergent compositions to the wash cycle and rinse additive compositions to the rinse cycle. These preferred devices are described in detail in PCT patent applications WO 03/69042 and WO 03/69043, both published Aug. 21, 2003. The disclosures of these PCT applications are incorporated herein by reference.

Thus in a preferred aspect of the invention, the method comprises:

(a) providing a unit dose package containing a laundry rinse additive material;

(b) inserting said additive-containing unit dose package into a rigid housing structure;

(c) at the beginning of the operation of the automatic washing machine positioning said housing structure, with said additive-containing unit dose package therein, within the drum of said automatic washing machine in a location which brings it into significant contact with the aqueous rinse liquor during the rinse cycle;

(d) running the automatic washing machine through a process comprising a spin cycle between the at least one wash cycle and the rinse cycle to thereby apply centrifugal force to said additive-containing unit dose package within said housing structure, said centrifugal force serving to activate the package opening means associated with said package or said housing structure or both, and to thereby open said package, release the contents thereof, and hold said contents within said rigid housing structure; and thereafter (e) removing the centrifugal force from said opened package by ending the spin cycle during operation of said automatic washing machine; and thereafter allowing the laundry additive material within said rigid housing structure to pass by gravitational flow through apertures in said housing structure into the aqueous rinse liquor during the rinse cycle in the operation of said automatic washing machine.

A further preferred aspect is a method which comprises:

(a) positioning a rigid housing structure within the washing machine in a fixed spatial relationship to said washing machine drum which housing structure comprises a base and an openable and closable lid for said base;

(b) placing within said housing structure with its lid open at the beginning of the laundering operation, a multi-compartmented insert containing within at least two different compartments thereof at least two different laundry additive materials of which one is to be added to the contents of the washing machine drum during the at least one wash cycle and one is to be added to the contents of the washing machine drum during the rinse cycle;

(c) closing the lid of said housing structure with said insert inside to thereby activate means associated with said rigid housing structure to open at least a first compartment of the multi-compartmented insert and to thereby permit dispensing of the material within said opened compartment into said washing machine drum; and (d) running said automatic washing machine through its operational cycle, including a spin cycle between the at least one wash cycle and the rinse cycle to thereby activate means associated with said housing structure and/or with said multi-compartmented insert to open one or more additional compartments of said insert containing laundry additive material different from that in said previously opened first compartment, said opening of said additional compartments occurring after initiation of the spin cycle of said washing machine operation, and said means for opening said additional compartments being activated by the centrifugal force arising from the spin cycle; said opening further permitting the dispensing of the material within said opened compartment(s) into said washing machine drum.

This latter aspect is particularly preferred.

The rigid housing structure used in this aspect of this invention must be positioned in a fixed spatial relationship to the washing machine drum. Preferably, the rigid housing structure will be positioned within the washing machine drum in a location such that it will be in contact with the wash or rinse water in or being added to the drum during the wash and rinse cycles of the laundering operation. The housing structure may be positioned on or near the washing machine agitator (if there is one) or may be positioned on the floor (top loaders) or rear wall (front loaders) of the drum. Most preferably, however, the rigid housing structure will be affixed to the inner circumferential wall of the washing machine drum in a position so that at least at some point during the washing and rinsing cycles it is in contact with water used in the cycle. For North American washing machines, this position will preferably be below the fill line for water in the drum.

The rigid housing structure will comprise a base element and an openable and closable lid for the base. Typically this arrangement will involve a hinged lid on a three-dimensional base element. The three-dimensional base element can be sized and configured in order to hold in an appropriate way the multi-compartmented unit dose package which carries the additive materials to be dispensed.

The rigid housing structure must also have means associated with it to open at least one of the compartments of the multi-compartmented insert which fits into it. Such means are generally activated by the closing of the lid of the housing structure once the multi-compartmented unit dose insert has been placed inside the structure. Such opening means can comprise, for example, selectively located puncturing or rupturing means such as sharp protrusions or knife blades which impinge on one or more of the selectively positioned compartments of the unit dose insert. The rupturing or puncturing means are then configured to move with the closing of the lid such that this movement causes the desired compartment(s) of the insert to be opened. Such compartment opening means may be associated with the housing structure base, the structure lid or both.

Alternatively, the opening means for the first compartment (s) of the insert could comprise an arrangement of holes or apertures in the housing structure which are opened as the lid of the housing structure is closed. Opening of the holes or apertures in the housing could then permit water from the washing step to enter the housing and dissolve those of the inert compartments which are water-soluble or which are at least openable by virtue of having water-soluble sealing means.

Preferably the rigid housing structure will also further comprise second means for opening additional compartments of the insert which is positioned therein. Such additional compartments will contain laundry additive materials which are different from those in the first compartment(s) initially opened as a consequence of the closing of the housing structure lid. These second means for opening additional compartment(s) of the unit dose insert are activatable by the centrifugal force applied to the housing structure during and as a consequence of the spin cycle during operation of the washing machine being used. Thus, for example, the second means for opening additional compartment(s) may also comprise sharp protrusions, blades or knives which will impinge on the additional compartment(s) of the unit dose insert which are to be opened during the spin cycle. The insert can be kept from initially contacting the second opening means (until the spin cycle), for example, by a hinged or otherwise movable positioning plate or baffle within the housing structure. Such a baffle or plate will hold the insert in a position such that the additional compartment(s) of the insert do not, upon initial closing of the housing structure, impinge upon the second compartment opening means. However, upon application of spin cycle centrifugal force, the insert can be held by the positioning plate or baffle in a position whereby the second compartment(s) will be moved by the applied centrifugal force into position for puncturing of the insert by the second compartment opening means. Alternatively, the preferred second opening means for additional compartments, like the initial opening means, can comprise a movable housing structure element which will open holes upon application of the spin cycle centrifugal force. Water entering though these opened holes can then dissolve or otherwise open the appropriately constructed and positioned additional compartment (s) of the insert. As with the opening means for the first insert compartment(s), the second means for opening additional compartment(s) of the insert may be associated with the housing structure base, the structure lid or both.

The rigid housing structure is also configured to permit water to eventually enter the structure during all of the various cycles of the laundering operation and to permit the contents of the opened insert compartments to be dispensed from the structure into the washing machine drum. Most frequently this configuration will include appropriately placed and positioned holes or apertures in the housing structure through which water from the laundering operation can enter and leave and through which laundry additive materials from the opened insert compartments can flow into the washing machine drum.

In a preferred configuration, the rigid housing structure will be able to hold substantially all (at least about 90% by weight) of the rinse additive contents of the spin-cycle opened insert within the rigid housing until the spin cycle is completed. Thus the centrifugal force which opens the additional insert compartment(s) can also be used to hold the contents released from the opened compartment(s) within the structure, and even in some cases still within the opened compartment(s) of the insert, until the spin cycle is over. At the conclusion of the spin cycle, when the centrifugal force ceases, the contents of the opened inserts can then be allowed to flow from the structure, for example by gravity through holes in the "bottom" of the structure. Alternatively, upon cessation of the spin cycle centrifugal force and addition of rinse water to the drum, the released rinse additive materials can be washed from the structure, and into the washing machine drum, by rinse water then entering the housing. By having the structure hold the released rinse additive materials until the spin stops, the rinse additive material can thereby be kept from being washed out of the washing machine drum by being forced out of the drum through the drainage holes in the drum wall during the spin cycle.

Opening of each of the several compartments of the insert within the housing structure should permit most (at least about 85% by weight), and preferably all, of the contents of the compartment so opened to be eventually combined with the wash or rinse water present in the washing machine drum during the cycle in which the compartment is opened. The wash water in the drum during the wash cycle will typically have delivered thereto from about 15 to 100 grams, preferably from about 40 to 80 grams, of laundry additive materials as a consequence of the opening of the wash additive compartment(s) of the insert. Rinse water in the drum for any rinse cycle during which a rinse additive compartment is opened in the insert will typically eventually have added thereto from about 5 to 50 grams, preferably from about 15 to 35 grams, of rinse additive material as a consequence of the opening of the rinse additive compartment(s).

The rigid housing structure can be fashioned from any suitable solid material including plastic, metal, ceramic, wood, etc. so long as the structure maintains its configuration and mode of operation through the laundering cycle and in contact with the wash and rinse water used and with the laundry additive materials released from the opened unit dose insert compartments. Preferably the rigid housing structure will be fashioned from thermoformed or injection molded plastic so that it can be readily and cost effectively mass-produced.

The multi-compartmented unit dose insert itself must be sized and configured so as to work cooperatively with the rigid housing structure into which it fits and within which it is used. The unit dose insert will thus comprise at least two separate compartments, at least one for laundry additive materials which are to be dispensed into the wash water at the beginning of the laundering operation and at least one for rinse additive materials which are to be dispensed into the subsequent rinse cycle during the course of the laundering operation. Of course, the unit dose insert may utilize more than one compartment for the wash water additive materials and more than one compartment for the rinse additive materials. This may be useful when two wash or rinse additive materials are incompatible with each other and may be desirably separately packaged until they are added to the washing machine drum.

Each compartment of the unit dose insert may be fashioned from water-insoluble materials, water-soluble materials or combinations of both types. Furthermore, some compartments of the insert may be made from water-insoluble materials while other compartments can be made from water-soluble materials. The compartments of the insert may also be flexible or rigid or have some compartments flexible and other compartments rigid.

If the unit dose insert is to be rigid, it may be made from any conventional polymeric material which can be thermoformed or injection molded. Thus polyethylene, polypropylene, polystyrene or polyester (e.g., polyethylene terephthalate) may be used to form the multi-compartmented insert. A polymer material should be chosen which has good heat stability, especially if the insert is to be utilized in European washing machines where water temperatures approach boiling. The material of the insert should also be inert to any chemicals which are present in the laundry additives which the insert is to deliver.

A preferred configuration for the unit dose insert comprises a multi-compartmented thermoformed tub formed from water-insoluble plastic, such as for example, polypropylene or polyethylene. The compartments of the tub can be sealed with a thin layer of puncturable or rupturable plastic or metal, e.g., aluminium, foil. In another preferred configuration, a pouch with the wash water additives may be flexible and fashioned from water-soluble materials, e.g., polyvinyl alcohol, and this water-soluble pouch may be affixed to a flexible or rigid pouch or compartment made from water-insoluble materials and containing the rinse additive materials to be dispensed later in the laundering cycle.

In a particularly preferred embodiment herein, the multi-compartmented insert itself may contain the means for opening the compartment(s) containing rinse additive materials. These are the compartments to be opened by means of the centrifugal force applied to the insert during the spin cycle of the laundering operation. Such rinse additive compartments may thus contain a frangible seal which comes apart or opens as pressure on the contents of the compartment increases as a consequence of the centrifugal force applied during the spin. Alternatively, the means for opening the rinse additive compartment(s) may be part of the housing structure as hereinbefore described. Of course, the means for opening the rinse additive compartment(s) must be present in association with at least one of the rigid housing structure or the multi-compartmented insert itself so that, one way or another, the rinse additive compartment(s) will be opened at the appropriate time during the laundering operation.

Figure 1B:
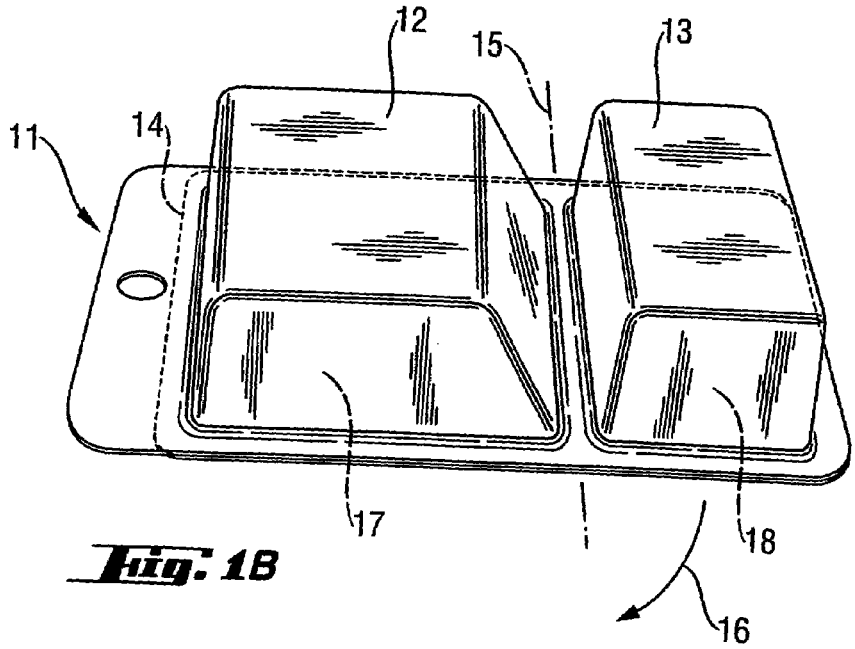

The multi-compartmented unit dose insert, the rigid, lidded housing structure and their relationship to each other for use in the systems and methods and kits herein are all illustrated further by the accompanying drawings. FIGS. 1A and 1B of the drawings show top and bottom views, respectively, of a two-compartment unit dose insert 11 which can be employed in the practice of the present invention. This compartmented unit dose insert 11 can be made of relatively rigid, insoluble thermoformed polypropylene. It has a major compartment 12 suitable for storage of liquid laundry additive 17, such as heavy duty liquid detergent, to be dispensed into the wash cycle of a laundering operation. The two-compartment unit dose insert 11 also has a smaller minor compartment 13 suitable for holding liquid laundry additive 18, such as fabric conditioning agent or pH control agents, to be dispensed into the rinse cycle of the laundering operation.

Prior to use, both compartments are sealed across the top with a puncturable or rupturable layer 14 of film or foil which covers both compartments 12 and 13. The material of construction of the insert 11 is not rigid enough to prevent the two compartments from rotating with respect to each other around an axis 15 represented by the strip of material between the two compartments. It is this rotation feature around an arc 16 which permits the centrifugal force-initiated movement and consequent puncturing of the rinse additive compartment 13 when the insert is placed within a housing structure as shown hereafter in FIG. 3.

Figure 2A:
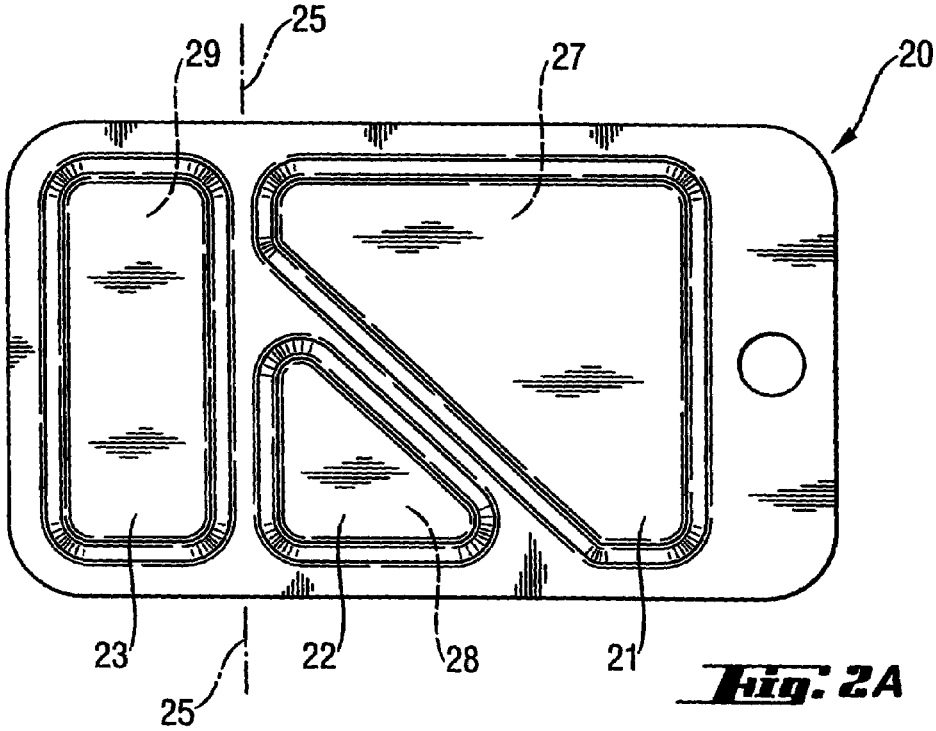
FIG. 2 of the drawings shows top and bottom views of another type of three-compartment unit dose insert which can be utilized in the present invention.
Figure 2B:
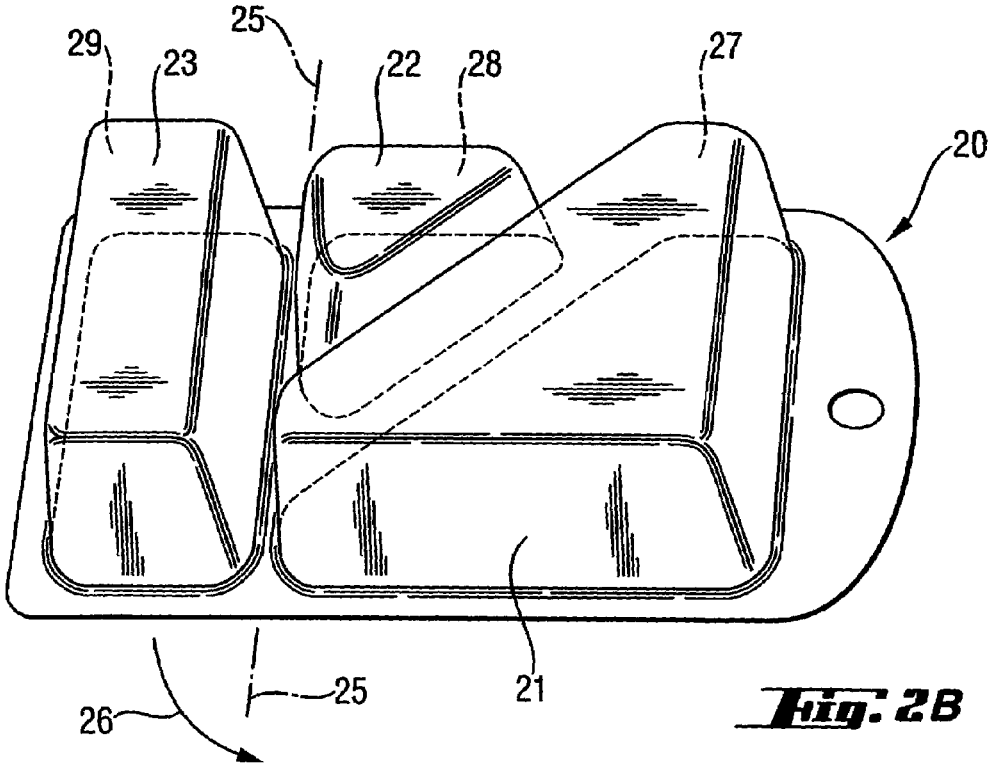

FIGS. 2A and 2B show top and bottom views, respectively, of a three-compartment unit dose insert 20 which can be employed in the practice of the present invention. This three-compartmented unit dose insert 20 has a large compartment 21 which holds a liquid laundry detergent product 27 and a smaller compartment 22 which holds a granular peroxygen bleaching agent product 28. It is the contents of compartments 21 and 22 which are incompatible with each other if combined prior to use, and which are both dispensed approximately simultaneously into the wash cycle when the compartments containing each are both initially opened at the beginning of the laundering operation. The third compartment 23 holds a liquid rinse additive product 29. It is this rinse additive product 29 which is later in the laundering operation to be dispensed into the rinse cycle and which includes a pH adjustment agent to bring the rinse to the required acid pH.

As in the two-compartment unit dose insert of FIGS. 1A/1B, the compartments of the FIGS. 2A/2B unit dose insert 20 are sealed across the top with puncturable or rupturable film or foil (not shown) prior to the insertion of the unit dose 20 into a housing structure for use in accordance with this invention. Also as with the FIGS. 1A/1B insert, the FIGS. 2A/2B unit dose insert 20 has an axis 25 between the wash additive compartments 21 and 22 and rinse additive compartment 23 around which the rinse additive compartment 23 can rotate relative to the 21 and 22 compartments following arc 26. It is this rotational feature around arc 26 which permits the eventual centrifugal force-induced movement and accordingly eventual puncturing of the acidic rinse additive compartment 23 when the insert 20 is placed into a housing structure as hereinafter illustrated in the FIG. 3 and FIGS. 4A, 4B and 4C depictions.

Figure 3:
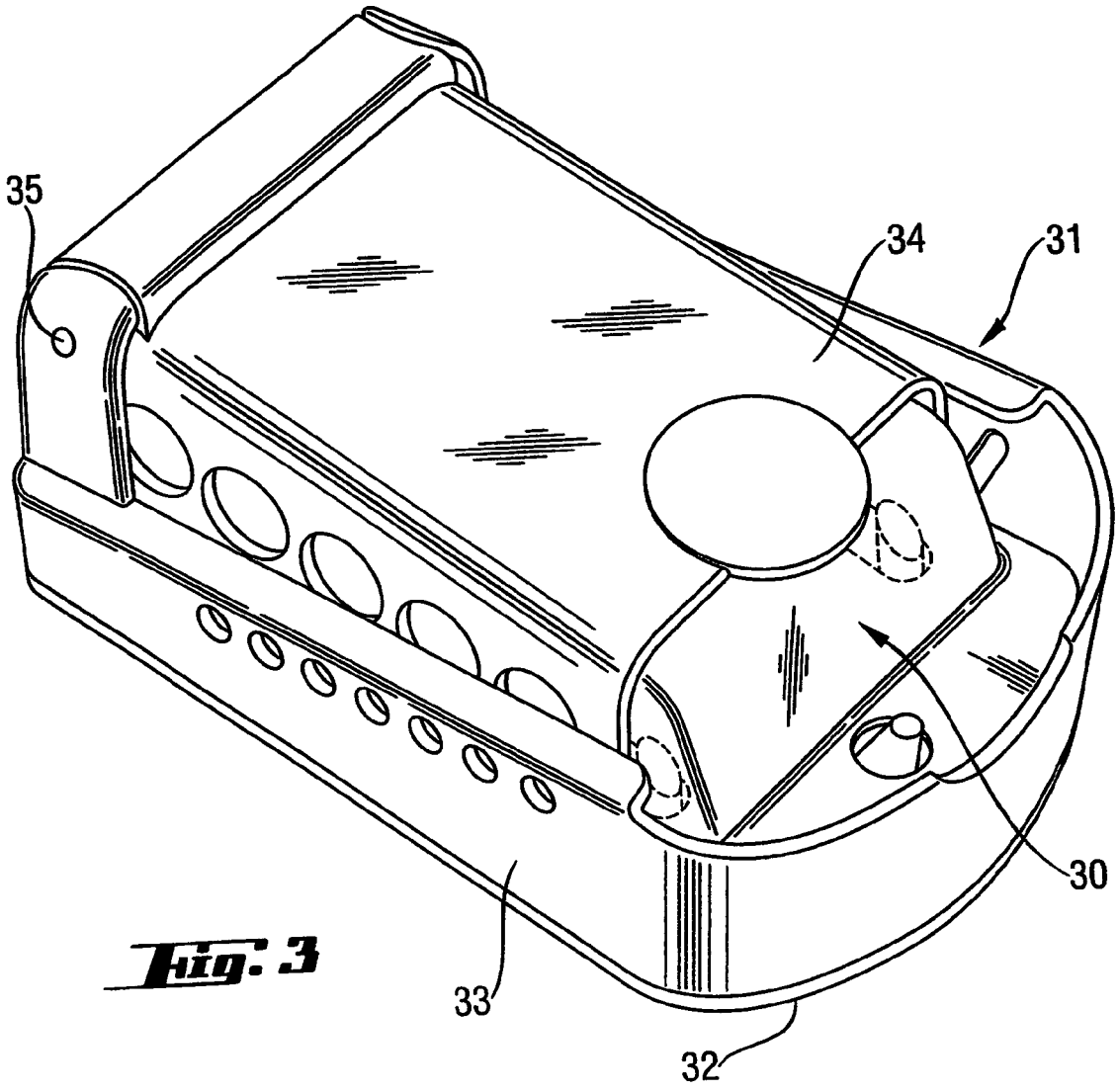
FIG. 3 of the drawings show a perspective view of a unit dose insert positioned within a closed rigid housing structure suitable for practice of the present invention.

FIG. 3 shows a perspective view of an insert 30, such as depicted in FIGS. 1A, 1B, 2A and 2B, which has been inserted into a lidded housing structure 31 which has been closed with the insert 30 inside. The housing structure 31 itself comprises a base plate 32 surrounded by a side wall structure 33 affixed to the base plate 32. A lid 34 completes the housing structure and is affixed to the side wall structure 33 by means of a hinge 35. More details of the internal components of the housing structure 31 are shown in the transparent side views of FIGS. 4A, 4B and 4C.

Figure 4A:
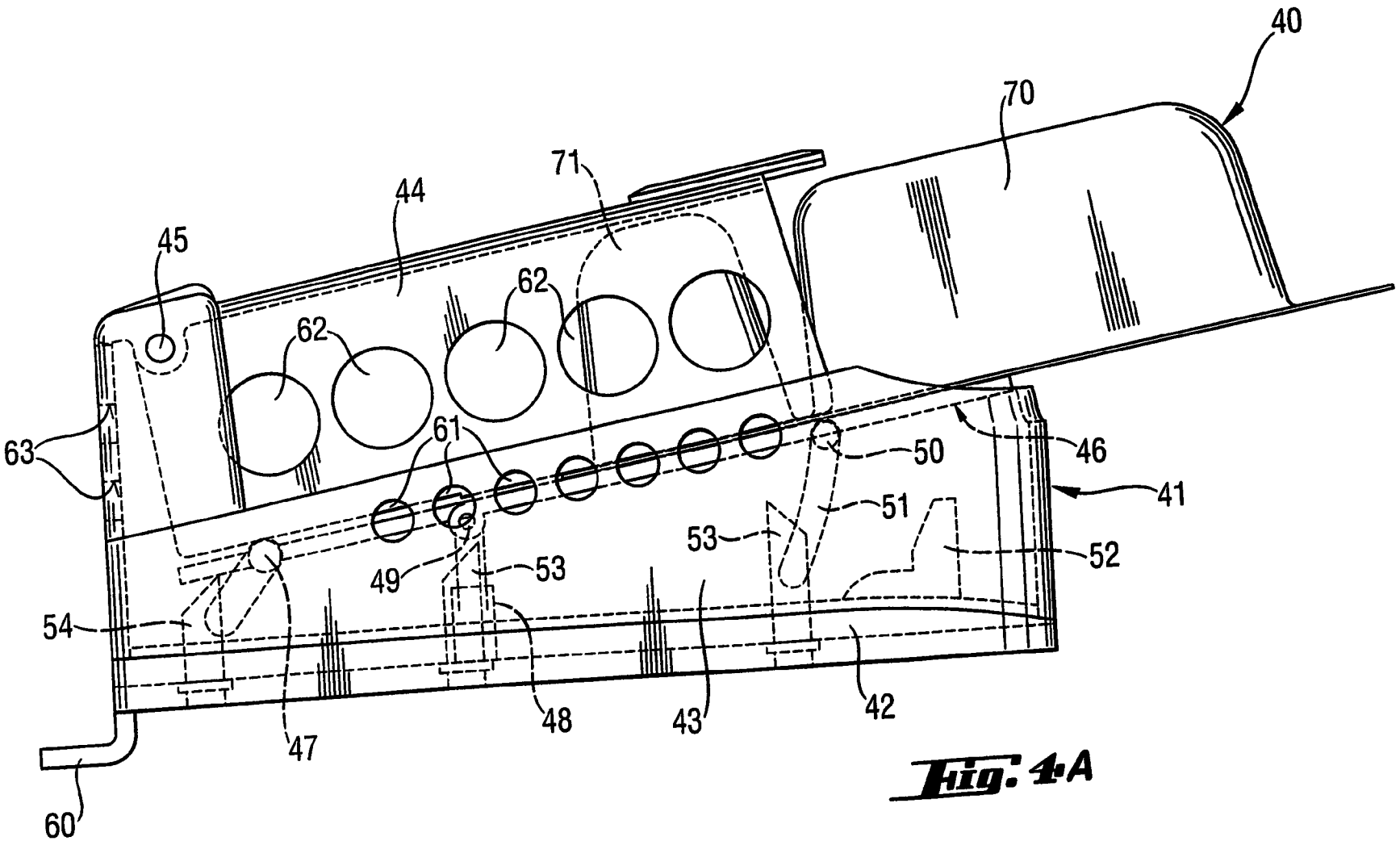
FIG. 4 of the drawings shows three side views of the insertion and use of a multi-compartmented unit dose insert into one embodiment of a lidded, rigid housing structure suitable for the practice of the present invention.
Figure 4B:
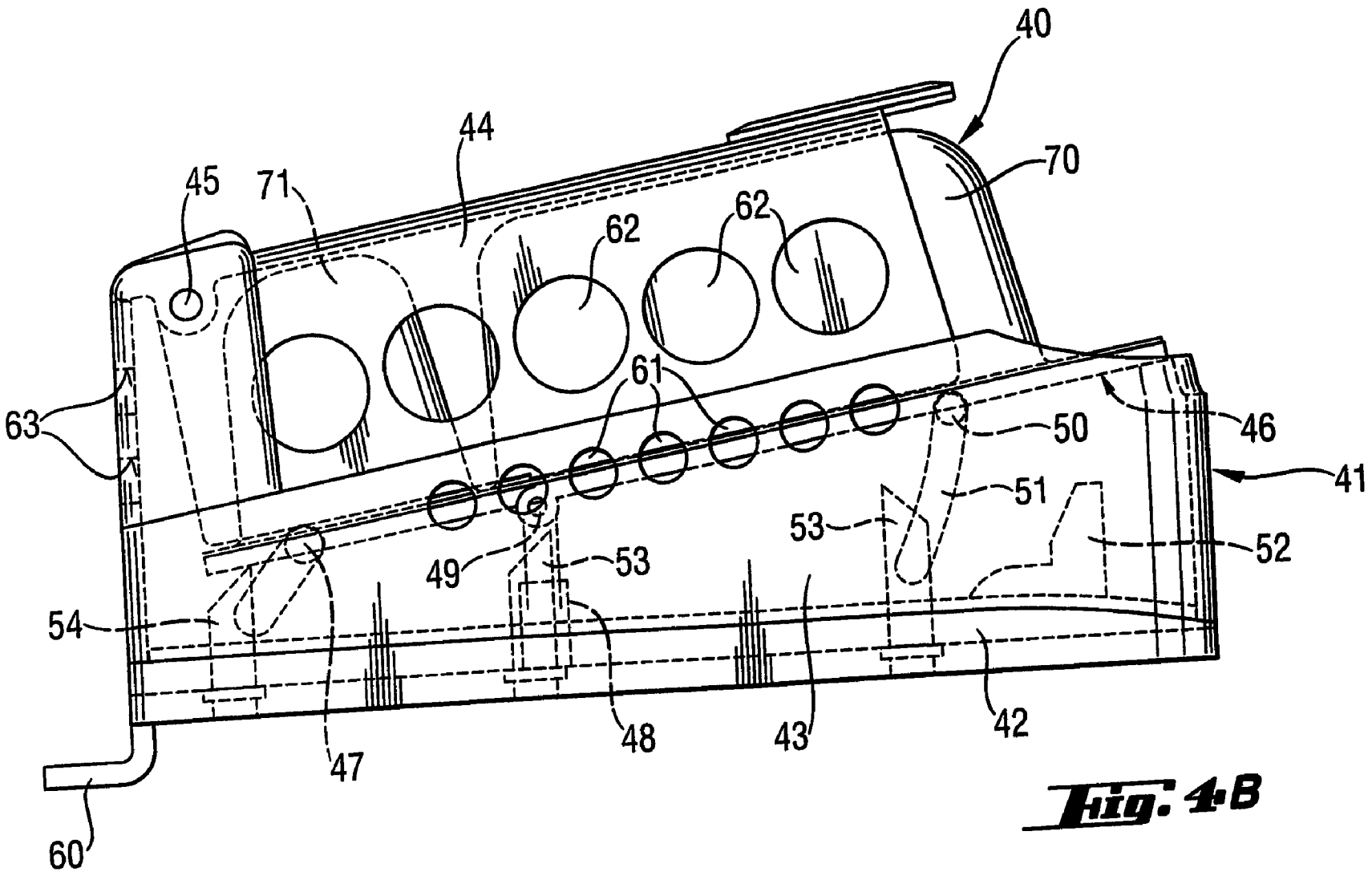
Figure 4C:
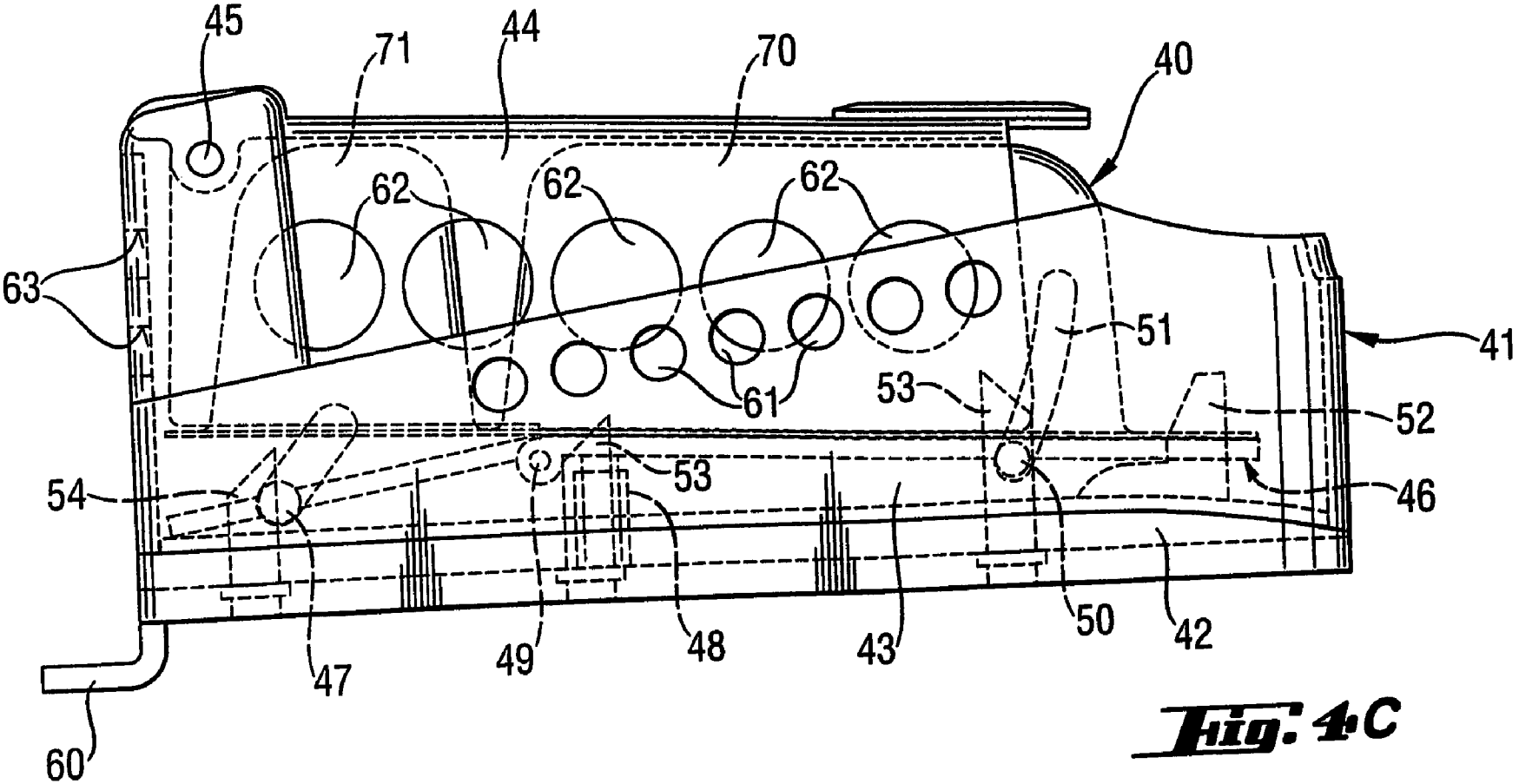

FIGS. 4A, 4B and 4C show transparent side views of an insert 40, such as depicted in FIGS. 1A, 1B, 2A and 2B, inserted into a housing structure 41. In all three of the FIG. 4 views, the housing structure 41 is shown as comprising a base which itself comprises a base plate 42 and a side wall structure 43 affixed to the base plate 42. A lid 44 for the housing structure 41 is attached to the side wall structure 43 at hinge 45.

The base plate 42 comprises attachment means 60 which are used to affix the housing structure 41 to the inside wall of an automatic washing machine drum (not shown). The housing structure 41 is affixed to the washing machine drum in a manner such that the base plate 42 is parallel to the axis of the washing machine drum and is hence perpendicular to the direction of centrifugal force which arises during the washing machine spin cycle.

FIG. 4A shows the housing structure 41 in an open position with the insert 40 partially inserted. FIG. 4B shows the housing structure 41 still in an open position but with the insert 40 completely inserted therein. FIG. 4C shows the housing structure 41, with the insert 40 inside, in a completely closed position, as illustrated hereinbefore in FIG. 3. In all three FIG. 4A-C views, the insert 40 is shown as comprising wash additive compartments 70 and rinse additive compartments 71. The insert 40 is inserted into the housing structure with the rinse additive compartments 71 positioned toward the hinge of the housing structure lid.

As shown in the three side views of FIG. 4, the housing structure 41 also comprises a hinged positioning plate 46. This hinged positioning plate 46 is affixed to or guided within the wall structure 43 by means of attachment means 47. This positioning plate 46 also rests on a compressible pivot point means 48. The positioning plate 46 is hinged at hinge point 49 near the compressible pivot point means 48. The positioning plate 46 also has lugs 50 at the wash additive end opposite the attachment means 47. These lugs 50 fit into guide grooves 51 in each of the opposing walls of the side wall structure 43.

When the lid 44 is closed, this activates rotation of the hinged positioning plate 46 around its hinge point 49 and at the same time depresses the compressible pivot point means 48. The wash additive end of the hinged positioning plate 46 thereby rotates toward the base plate 42 and is kept in the closed position by means of a latch mechanism 52 associated with the base plate 42.

Thus, as the lid 44 is closed, the rotating of the wash additive end of the hinged positioning plate 46, is guided by the lugs 50 in the grooves 51 in the manner of a cam arrangement as the structure is placed in the closed latched position.

As a consequence of closing and latching, the wash additive compartment(s) 70 of the insert 40 thus impinge upon sharpened, cylindrical wash additive puncturing means 53 associated with the base plate 42. This action punctures the wash additive compartment(s) 70 of the insert 40 and releases the wash additive contents thereof into the housing structure 41. As shown in FIG. 4C, this action also serves to position the rinse additive compartment(s) 71 of the insert 40 above, but not in contact with, sharpened cylindrical rinse additive puncturing means 54, also associated with the base plate 42.

Later in the laundering operation, during the spin cycle, the centrifugal force generated by the spin cycle causes the rinse additive compartment(s) 71 of the insert 40 to rotate toward the base plate 42. This action then causes the acidic rinse additive compartments 71 of the insert 40 to impinge upon additional rinse additive compartment puncturing means 54 also associated with the base plate 42. The acid rinse additive compartments 71 of the insert 40 are thus ruptured, thereby releasing their contents into the housing structure 41. The housing side wall structure 43 contains holes 61 through which released contents of the insert compartments can flow into the washing machine drum. Likewise, the lid 44 contains holes 62 for the same purpose.

Rinse additive released by spin cycle centrifugal force is held in the bottom of the housing structure 41 until the spin cycle stops. This released rinse additive can then flow by gravity through holes 63 at the lid hinge end of the housing structure 41 and into the washing machine drum.

EXAMPLE I

The table below shows, as Composition A, a composition particularly suitable for addition to a top loading, single rinse cycle automatic washing machine. Also shown is Composition B which is particularly suitable for addition to the final rinse cycle in a multi rinse cycle, front loading automatic washing machine. 30 grams of each composition is added to the relevant rinse cycle.

| Ingredient | A (wt %) | B (wt %) |
|---|---|---|
| Maleic acid | 22.4 | 16.7 |
| 1,1-ethyl hydroxy diphosphonic acid (HEDP) | — | 1.7 |
| Neodol 23-5 (nonionic surfactant) | 3.3 | 3.3 |
| Perfume | 1.3 | 1.7 |
| Water | balance | balance |

EXAMPLE II

A three-compartment unit dose insert is prepared having the general configuration of that shown in FIG. 2. The insert is fashioned from 0.381 mm thick polypropylene and is made by a thermoforming process. The insert so formed is 11.0 cm long, 7.0 cm wide and 2.5 cm thick and includes the three compartments, 21, 22 and 23 shown in FIG. 2.

Approximately 55 grams of a compact aqueous heavy duty liquid (HDL) detergent product are placed in the larger wash additive compartment 21 of the FIG. 2 insert. Such an HDL comprises approximately 40% by weight of anionic and nonionic surfactants, 8% by weight of organic builders, 19% by weight of organic solvents and minor amounts of other ingredients such as borax and enzymes.

Approximately 11 grams of a liquid bleaching composition are placed in the smaller wash additive compartment 22 of the FIG. 2 insert. Such a composition comprises a 17% by weight aqueous slurry of δ-phthalimidoperoxy hexanoic acid (PAP) along with minor amounts of perfume.

Approximately 30 grams of a liquid acidic rinse additive composition are placed in the rinse additive compartment 23 of the FIG. 2 insert. Such an aqueous liquid rinse additive composition comprises approximately 22.4% by weight of maleic acid and minor amounts of nonionic surfactant and perfume, as shown in Composition A hereinbefore in Example I.

The insert, with the compositions as hereinbefore described in each of the three compartments, is sealed with a 0.0304 mm layer of oriented polypropylene film placed over the open compartments. The sealed unit dose insert package is then placed in a rigid lidded housing structure of the type shown in FIGS. 3 and 4. Prior to insertion of the unit dose package, this rigid housing structure is attached to the circumferential wall of the upright drum of a top-loading Kenmore 70 Series automatic washing machine. The housing is attached approximately 20 cm from the floor of the drum with the lid hinge closest to the floor of the drum and with the structure backplate parallel to the circumferential wall of the drum. The open end of the housing structure thus faces the top of the washing machine.

With the lidded housing structure in the open configuration, the three-compartment unit dose insert is placed therein as shown in FIGS. 4A and 4B. Fabrics to be laundered are then placed in the washing machine. Just prior to starting the washing machine on its laundering cycle, the lid of the housing structure is closed providing the structure and insert configuration as shown in FIG. 4C. The washing machine is then started on its cycle.

Closing of the housing structure lid with the insert inside causes the wash additive puncturing means 53 (FIG. 4) to rupture the layer of sealing material covering the each of the additive compartments 21 and 22 (FIG. 2) of the insert. Such rupturing releases the wash additive ingredients together into the wash water which fills the tub at the beginning of the laundry cycle. The wash additive ingredients are washed from the housing structure through the holes 61, 62 and 63 (FIG. 4) in the walls of the housing structure, thereby providing wash water to which about 66 grams of wash additive ingredients (HDL plus bleach) have been added. The wash liquor so formed has a pH of approximately 8.5.

After a wash cycle of approximately 14 minutes, the washing machine begins its spin cycle to remove the wash water from the drum. The centrifugal force generated by this spin cycle serves to push the sealed rinse additive compartment 71 (FIG. 4) of the insert within the housing against the rinse additive rupturing means 54 (FIG. 4) which forms part of the rigid housing. This action causes the seal of the rinse additive compartment 71 (FIG. 4) to rupture and release the maleic acid-containing contents of the rinse additive compartment into the housing structure. The continuing centrifugal force of the spin cycle holds the released acidic rinse additive composition in an area of the housing structure where there are no holes so that the released acidic rinse additive stays within the housing structure during the spin cycle.

After 2 minutes of the spin cycle, the spinning of the washing machine drum ceases and the drum begins filling with rinse water. At the same time, the maleic acid rinse additive composition which has been held within the housing structure during the spin cycle flows from the housing structure primarily through the holes 63 (FIG. 4) and into the rinse water. Rinse water in and entering the drum can also now enter the housing structure and wash out any residual acidic rinse additive composition from the open rinse additive compartment. In this manner approximately 30 grams of the acidic rinse additive composition are introduced into the rinse water in the washing machine drum. This amount is sufficient to provide a rinse water pH of approximately 5.5 during the rinse cycle.

The rinse cycle continues for 5 minutes and thereafter the fabrics in the drum are wrung dry by a final spin cycle. Wash and rinse additives from the insert have thus been delivered sequentially to the wash and rinse cycles respectively during the laundering operation. This sequential addition of these types of ingredients provides a pH profile for the laundering operation which ranges from a pH of 8.5 in the wash liquor down to a pH of 5.5 in the rinse water during the rinse cycle.

What is claimed is:

1. A method of laundering fabrics in an automatic washing machine having a drum, wherein the automatic washing machine is operated so as to cause it to run through at least one wash cycle and at least one rinse cycle, which method comprises:

(a) positioning a rigid housing structure within the washing machine in a fixed spatial relationship to said washing machine drum which housing structure comprises a base and an openable and closable lid for said base;

(b) placing within said housing structure with its lid open at the beginning of the laundering operation, multi-compartmented insert containing within at least two different compartments thereof at least two different laundry additive materials of which one is to be added to the contents of the washing machine drum during the at least one wash cycle and one is to be added to the contents of the washing machine drum during the rinse cycle;

(c) closing the lid of said housing structure with said insert inside to thereby activate means associated with said rigid housing structure to open at least a first compartment of the multi-compartmented insert to thereby permit dispensing of the material within said opened compartment into said washing machine drum; and (d) running said automatic washing machine through its operational cycle, including a spin cycle between the at least one wash cycle and the rinse cycle to thereby activate means associated with said housing structure and/or with said multi-compartmented insert to open one or more additional compartments of said insert containing laundry additive material different from that in said previously opened first compartment, said opening of said additional compartments occurring after initiation of the spin cycle of said washing machine operation, and said means for opening said additional compartments being activated by the centrifugal force arising from the spin cycle; said opening further permitting the dispensing of the material within said opened compartment(s) into said washing machine drum, further comprising (a) during the at least one wash cycle forming in the drum an aqueous washing liquor containing a detersive surfactant component and a detergent builder component, the aqueous wash liquor having pH above about 7;

(b) contacting fabrics to be laundered with the aqueous wash liquor in the drum:

(c) during the rinse cycle, forming in the drum an aqueous rinse liquor and contacting the fabrics with said rinse liquor; and (d) adding to the rinse liquor sufficient acid source to bring the pH of the rinse liquor into the range of from about 4 to about 7.

2. A method according to claim 1 which comprises contacting the laundry with the aqueous wash liquor for from about 1 to about 50 mins, removing from about 50% to 99% of the aqueous wash liquor from the drum during a spin cycle carried out between the wash cycle and the rinse cycle, and contacting the fabrics with the aqueous rinse liquor for from about 1 to 20 minutes.

3. A method according to claim 1 in which a laundry rinse additive is added during the rinse cycle.

4. A method according to claim 3 in which the rinse additive is a perfume or pro-perfume.

5. A method according to claim 3 in which the rinse additive is a chelant.

6. A method according to claim 3 in which the rinse additive is a fabric brightening agent.

7. A method according to claim 3 in which the rinse additive is a fabric care benefit agent selected from softness, feel and wrinkle modifiers.

8. A method according to claim 3 in which the rinse additive is a soil release agent or soil repellent agent.

9. A method according to claim 3 in which the rinse additive is a bleach or bleach catalyst.

10. A method according to claim 1 in which the fabric laundered comprises fabric stained with stains selected from bleachable stains, greasy stains and stains susceptible to removal by enzymes.

11. A method according to claim 1 in which the fabrics laundered comprise dyed fabrics.

12. A method according to claim 1 in which the maximum temperature of the aqueous wash liquor and the aqueous rinse liquor is not more than about 60° C.

13. A method according to claim 1 in which the hardness of the water used to form the aqueous wash liquor and the aqueous rinse liquor is at least about 100 ppm as $CaCO_3$.

14. A method according to claim 1 in which the aqueous wash liquor is provided by adding to water a detergent composition in the form of a liquid and wherein the pH of the aqueous wash liquor so provided is not more than about 10.

15. A method according to claim 1 in which the aqueous wash liquor is formed by adding to water a detergent composition comprising a surfactant selected from anionic, nanionic, cationic and amphoteric surfactants, preferably selected from linear alkyl benzene sulphonates, alkyl ethoxylates, amine oxides, alkyl quaternary ammonium salts and betaines.

* * * * *

UNITED STATES PATENT AND TRADEMARK OFFICE

CERTIFICATE OF CORRECTION

PATENT NO. : 7,445,643 B2
APPLICATION NO. : 11/003896
DATED : November 4, 2008
INVENTOR(S) : Eugene Steven Sadlowski et al.

It is certified that error appears in the above-identified patent and that said Letters Patent is hereby corrected as shown below:

Claim 1, Column 17
Line 27, before "multi-compartmented" insert -- a --.
Line 37, before "to" insert -- and --.
Claim 1, Column 18
Line 5, delete ":" and insert -- ; --.
Claim 15
Line 54-55, delete "nanionic" and insert -- nonionic --.

Signed and Sealed this

Twenty-sixth Day of May, 2009

JOHN DOLL
*Acting Director of the United States Patent and Trademark Office*